United States Patent [19]

DeGrazia, Jr.

[11] Patent Number: 4,905,643

[45] Date of Patent: Mar. 6, 1990

[54] REMOTELY ACTUATED, REVERSIBLE DRAIN VALVE

[76] Inventor: Torey W. DeGrazia, Jr., 1014 S. Greenwood Dr., Park Ridge, Ill. 60068

[21] Appl. No.: 367,973

[22] Filed: Jun. 19, 1989

[51] Int. Cl.[4] ..... F01M 1/00

[52] U.S. Cl. ..... 123/196 S; 184/106

[58] Field of Search ..... 123/196 K, 196 S; 184/1.5, 106; 251/294; 137/351, 139

[56] References Cited

U.S. PATENT DOCUMENTS

| | | | |
|---|---|---|---|
| 2,187,247 | 1/1940 | Nichols | 137/139 |
| 3,049,334 | 8/1962 | Montague | 251/294 |
| 3,422,807 | 1/1968 | Schossow | 137/351 |
| 3,664,633 | 5/1972 | Schaffner | 251/294 |
| 4,086,981 | 5/1978 | Mitsui | 184/1.5 |
| 4,319,664 | 3/1982 | Price et al. | 184/1.5 |
| 4,495,963 | 1/1985 | Hensley | 137/351 |
| 4,676,206 | 6/1987 | DeGrazie, Jr. | 123/196 S |

FOREIGN PATENT DOCUMENTS

| | | |
|---|---|---|
| 812693 | 5/1937 | France . |
| 1402262 | 8/1975 | United Kingdom . |
| 1448024 | 9/1976 | United Kingdom . |

*Primary Examiner*—E. Rollins Cross

*Attorney, Agent, or Firm*—Neuman, Williams, Anderson & Olson

[57] ABSTRACT

A reversible drain valve that is remotely actuated is disclosed. The valve includes a longitudinal fluid passageway having a pair of identical connecting means located at opposite ends. An outlet sleeve having a sealing surface is joined with either of the connecting means. A closure member is joined with the other connecting means and cooperates with the longitudinal passageway to form a valve chamber. A cable actuated valve member is urged to a closed position against the sealing surface with the use of a biasing spring and fluid collected in the valve chamber.

7 Claims, 2 Drawing Sheets

REMOTELY ACTUATED, REVERSIBLE DRAIN VALVE

BACKGROUND OF THE INVENTION

The present invention relates to a drain device for removing fluid from a fluid reservoir. In particular, the invention relates to a drain valve that is remotely operated for draining or removing fluids such as oil from a reservoir such as the oil sump of an internal combustion engine. The drain valve of this invention is easy to use and facilitates rapid and efficient oil removal, while being highly reliable and trouble-free in operation. It is relatively simple in construction, and is economically manufacturable.

The commonly used method of draining oil from the crankcase of an engine involves physically removing or unscrewing a drain plug from the oil drain outlet of the oil pan. While this method generally accomplishes its intended purpose, it is necessary for the person draining the oil to either jack up the vehicle or crawl underneath the vehicle to physically remove the drain plug. With varying locations and orientations of the drain plug on vehicles, it is often difficult for the person draining the oil to easily access the drain plug.

Prior art types of drain valves to facilitate removal of the oil from a crankcase are known. One such device operates with the use of a piston that is positioned to seal the drain outlet. British Pat. No. 1,448,024 to Schwary is an example of such a prior art device. In Schwary, a drain valve is disclosed which includes a longitudinal output passageway, a perpendicular inlet passageway and a spring biased piston disposed in the longitudinal passageway to prevent oil from entering the longitudinal passageway in the closed position. Sealing is accomplished with the use of sealing rings around the piston that form a seal with the inner surface of the housing enclosing the longitudinal passageway. In operation, the piston rings travel through the inlet of the valve, thereby exposing the piston rings to uneven pressure, reducing the useful life of the piston. The output flow of the valve is not readily reversible. While this arrangement is suitable for drain openings on the bottom of a crankcase, it is unsuitable for other applications.

Other types of drain valves have been proposed in the past but they have suffered from various shortcomings. In particular, such drain valves have been unnecessarily complex. Although these systems may work effectively when new, breakdowns from wear occur after the systems get older.

OBJECTS OF THE INVENTION

Accordingly, a general object of the invention is to provide an improved valve especially well adapted for use as a remotely controlled drain valve.

An additional object of the present invention is to provide a drain valve of a symmetrical design such that it is reversible.

A further object of the present invention is to provide a drain valve that avoids the frequent breakdowns which may occur in more complex valves.

Another object of the present invention is to provide an inexpensive and easy-to-manufacture drain valve.

Other objects and advantages of the present invention will become apparent upon reading the following description and appended claims, and upon reference to the accompanying drawings.

SUMMARY OF THE INVENTION

The above objects are accomplished by providing a remotely actuated reversible drain valve for removing fluid from a fluid reservoir. The drain valve has a simple design and is effective in operation.

In accordance with one embodiment, a drain valve comprises a valve body that includes a longitudinal section defining a fluid passageway. The longitudinal section has a pair of substantially identical connecting means located at its opposite ends. The valve body also includes a transverse section defining a fluid passageway intended to communicate with a fluid reservoir and communicate with the longitudinal passageway. The transverse section further includes connecting means to interconnect with the drain outlet of the fluid reservoir.

An outlet sleeve which defines an annular sealing surface or a valve seat within the longitudinal passageway is joined to the longitudinal passageway through one of the pair of connecting means. The sleeve defines an outlet port and may be adapted to receive an outlet tube or other suitable means to direct escaping fluid in a desired direction.

A closure member is joined to the longitudinal section through the other of the pair of connecting means. When in place, the closure member and the longitudinal passageway define a valve chamber closed by a valve member or plunger for retaining fluid.

The valve plunger has an open position and a closed position within the valve chamber. The valve plunger includes a generally cylindrical sealing head that forms a seal with the sleeve seat when the valve plunger is placed in the closed position.

A cable means extending from a remote location is received within the closure member through a longitudinal aperture in the closure member and is connected to the sealing head of the valve plunger which carries a sealing washer. In operation, the longitudinal motion of the cable means withdraws the sealing head and in turn the washer from the seat of the outlet sleeve to move the sealing head to the open position. In this open position, the fluid path from the transverse section to the outlet sleeve is left unobstructed, permitting the fluid to escape the fluid reservoir.

The drain valve also includes a biasing spring which projects between the closure member and the valve closing plunger. The biasing spring urges the valve plunger and washer toward the seat to bias the valve member to a normally closed position. A particular advantage of the present invention is the cooperation of the biasing spring with fluid pressure in the valve chamber. The valve plunger and washer are loosely fitted within the longitudinal passageway. Thus, as the washer approaches the seat, fluid pressure in the reservoir augments the biasing force of the spring to insure more positive closure. This feature also reduces wear on the outside surface of the valve plunger and the inside surface of the longitudinal section.

Another advantage of the present invention is the reversibility of the direction of the outlet. Since the outlet sleeve and closure member are secured with substantially identical connecting means, they may be conveniently interchanged. This feature solves many problems associated with mounting the drain valve and permits versatile manifolding.

It should be understood that the drawings are not necessarily to scale. In certain instances, details of the actual structure which are not necessary for the understanding of the present invention have been omitted. It should be understood, of course, that the invention is not necessarily limited to the particular embodiments illustrated herein.

DETAILED DESCRIPTION OF THE PREFERRED EMBODIMENTS

Figure 1:
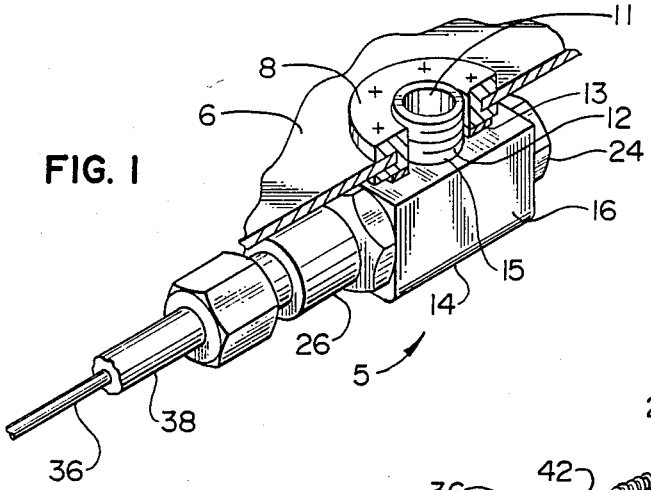
FIG. 1 is a perspective view of the drain valve of the present invention.

Referring now to FIG. 1, a drain valve embodying the present invention is generally designated by the numeral 5. Drain valve 5 has a particular application for facilitating the removal of oil from an oil sump of a crankcase engine. However, the invention may be used for the removal of other fluids from a fluid reservoir wherein a remote operation of the drain valve is desired.

Figure 2:
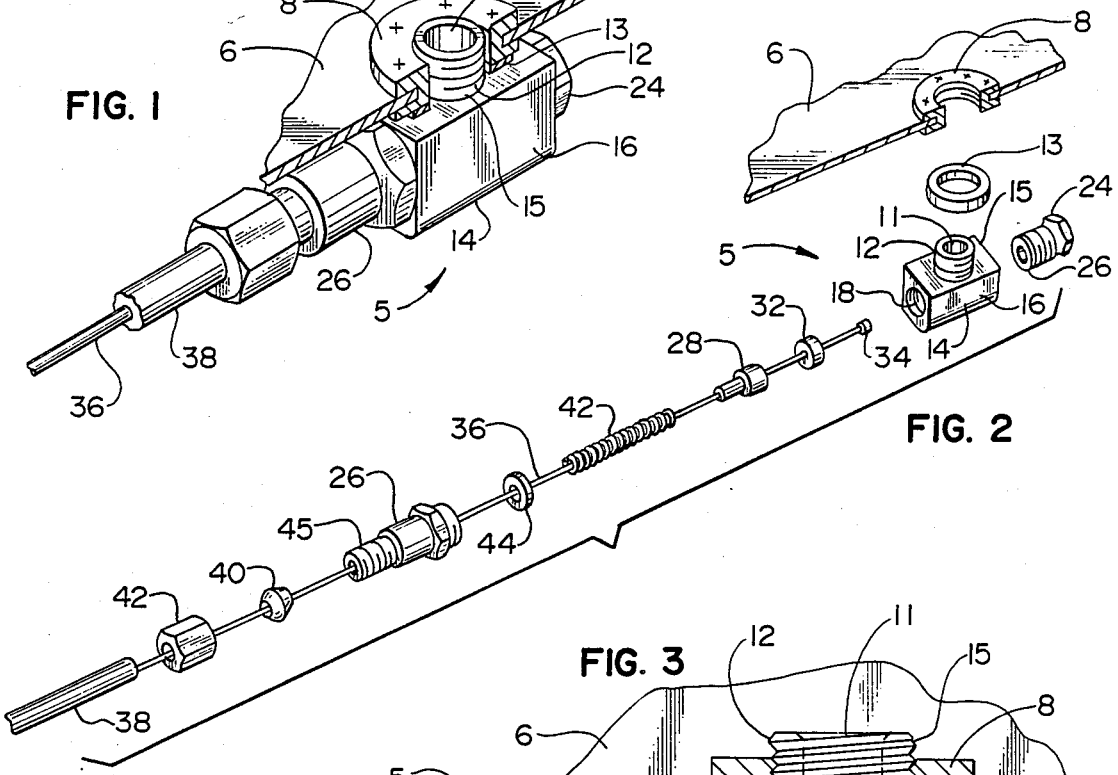
FIG. 2 is an exploded perspective view of the drain valve shown in FIG. 1.

FIG. 2 shows drain valve 5 comprising a drain valve body 14. Drain valve body 14 defines a longitudinal fluid passageway 16 and a transverse section 12. This transverse section 12 defines an inlet passageway 11 for communication with the longitudinal fluid passageway 16. Transverse section 12 includes connecting means adjacent the distal end of transverse section 12 to provide fluid communication between inlet passageway 11 and a fluid reservoir, particularly an oil sump 6 of an engine crankcase. Preferably, the connecting means associated with transverse section 12 comprises a threaded portion 15 to mate with the engine oil sump drain opening 8 after removal of the conventional drain plug (not shown). A gasket washer 13 surrounds transverse section 12 for abutting against the edge of oil sump 6 and valve body 14. The gasket washer promotes a tight seal between the oil sump drain opening 8 and drain valve 5.

Figure 3:
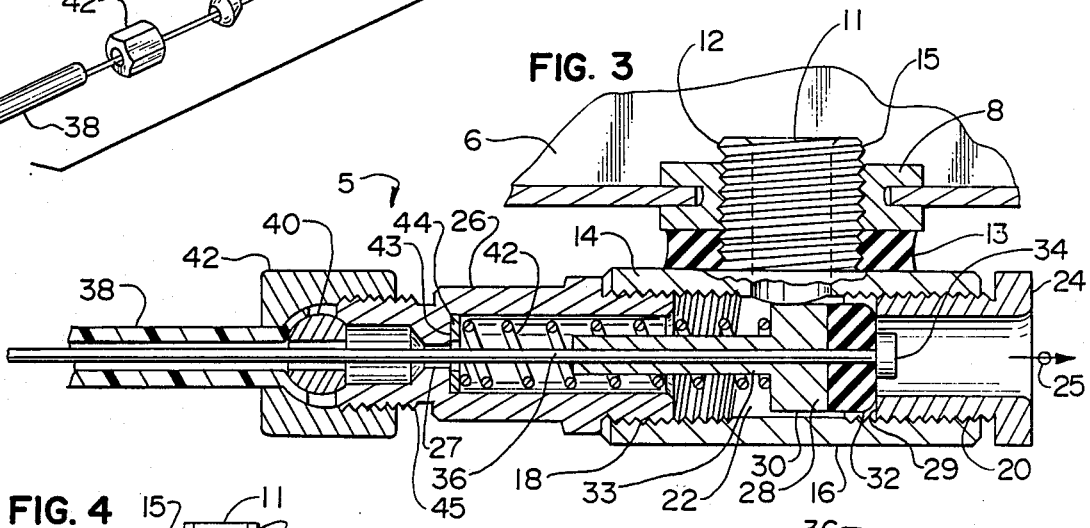
FIG. 3 is a detailed sectional view of the drain valve of FIG. 1.

As best shown in FIG. 3, valve body 14 includes two substantially identical connecting means located at the opposite ends of longitudinal passageway 16, shown as threaded ends 18 and 20. Longitudinal passageway 16 is part of a valve chamber 22 and communicates with inlet passageway 11, extending longitudinally between the threaded ends 18 and 20 of section 16. In the preferred embodiment, valve body 14 is constructed of brass.

At one threaded end 20 of longitudinal passageway 16, an outlet sleeve 24 forms the outlet of drain valve 5, wherein the escaping fluid flows in the direction denoted by arrow 25. The interior surface of outlet sleeve 24 is preferably smooth to provide a surface for the oil to exit drain valve 5. Sleeve 24, however, may be adapted to receive an exit tube or pipe to direct the oil to a desired location. The inward edge of sleeve 24 forms an annular sealing surface or a valve seat 29 and is located between inlet passageway 11 and the end of longitudinal passageway 16 when outlet sleeve 24 is threaded within longitudinal passageway 16. Sleeve 24 is also slightly tapered at its outlet end to encourage a uniform outward flow of oil. While outlet sleeve 24 is shown mating with threaded end 20 of longitudinal passageway 16, it could just as easily mate with threaded end 18 of passageway 16. Outlet sleeve 24 is preferably constructed of brass.

A closure member, also preferably constructed of brass, is shown as cable end fitting 26 that mates with the other threaded end 18 of longitudinal passageway 16. The interior surface of cable end fitting 26 cooperates with longitudinal passageway 16 to form a valve chamber 22 for drain valve 5. Cable end fitting 26 includes an aperture 27 for enclosing an actuating cable 36 and an annular surface 43 to provide a stop for a biasing spring 42. Cable end fitting 26 could just as easily mate with threaded end 20 of longitudinal passageway 16. Since outlet sleeve 24 and cable end fitting 26 are conveniently mounted on either end of longitudinal passageway 16, the direction of outlet flow of drain valve 5 may be easily reversed. This feature is particularly advantageous when drain valve 5 is mounted on the side of an oil sump 6 since one of the ends of longitudinal passageway 16 may be directed upwardly when the transverse section 12 of drain valve 5 is securely threaded within the drain opening 8 of oil sump 6.

Drain valve 5 further includes a valve member or plunger 28 placed within the valve chamber 22 of drain valve 5. Valve plunger 28 includes a generally cylindrical sealing head 30 which includes a drain washer 32. Drain washer 32 preferably formed of a compressible material, most preferably rubber. Drain washer 32 may be snap fit over the sealing head 30 of valve plunger 28. Drain washer 32 may also be secured against head portion 30 with the use of a cable end rivet 34. Valve plunger 28 further includes an elongated portion 33 that is formed to receive the actuating cable 36 and also interfit within a biasing spring 42.

The valve plunger 28 is actuated with the use of cable means, shown as cable 36. Cable 36 is remotely operated with the use of pull means or lever means (not shown). Cable 36 is also enclosed with a protective sheave 38. A cable end farrell 40 and cable end nut 42 that mates with a threading 45 formed in cable end fitting 26 receive sheave 38 to tightly seal the valve chamber at the cable end.

A valve spring 42 biases the valve plunger 28 in a normally closed position. Valve spring 42 projects between the annular surface 43 of cable end fitting 26 and sealing head 30. Valve spring 42 is further interfitted with the elongated portion 33 of valve plunger 28 to maintain proper orientation of the valve spring 42. A washer 44 may abut the annular surface 43 of cable end fitting 26 to aid in positioning valve spring 42 against the head portion 30 of valve plunger 28.

In operation, the valve biasing spring 42 biases drain washer 32 against the valve seat 29 of outlet sleeve 24. However, oil also collects within the valve chamber 22 thereby creating oil pressure within the valve chamber 22. This oil pressure within the valve chamber 22 of drain valve 5 aids in moving drain washer 32 against the valve seat 26 of outlet sleeve 24. The oil pressure within valve chamber 22 further cooperates with valve biasing spring 42 to maintain closure tension on valve plunger 28. Therefore, the valve plunger 28 is loosely fit within the valve chamber 22 to increase oil pressure within the valve chamber 22. This arrangement increases the life of drain valves since valve plunger 28 is less subject to sticking or wear against the inside surface of longitudinal section 16.

To actuate the drain valve, the flexible cable 36 withdraws the valve washer 32 from its normally closed position against the valve seat 29 of outlet sleeve 24. Any suitable lever means or pull means may be used to actuate cable 36 and thereby withdraw valve plunger 28. In the open position, valve plunger 28 is urged toward cable end fitting 26, leaving an unobstructed path between the inlet passageway 11 and outlet sleeve 24. Fluid is thereby discharged in the direction of arrow 25. An interfitting tube or pipe may be placed in outlet 25 and extend externally of drain valve 5 to direct the oil in any desired direction.

Figure 4:
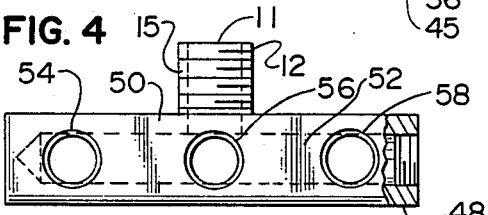
FIG. 4 is a sectional view of an alternate embodiment of the present invention showing a mixing valve with multiple valve sections.
Figure 5:
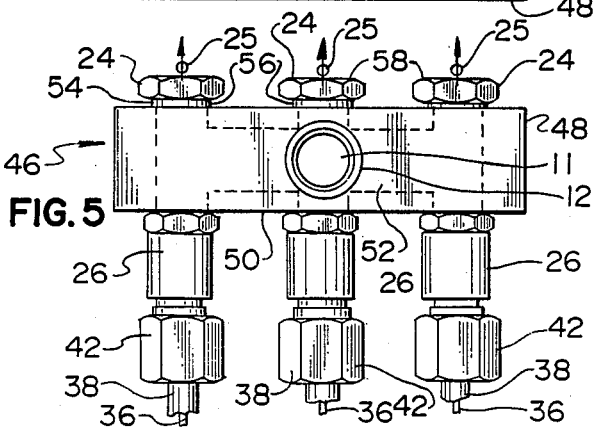
FIG. 5 is a top view of the alternate embodiment of FIG. 4.
Figure 6:
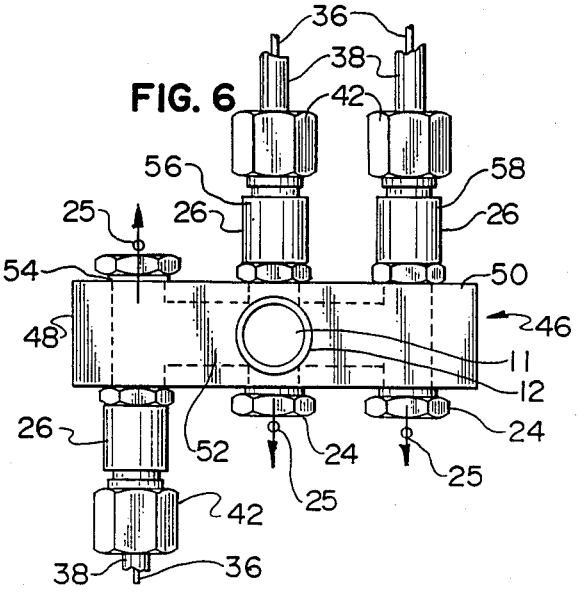
FIG. 6 is a top view of the alternate embodiment of FIG. 4 with the direction of one of the valves reversed.

Turning now to FIGS. 4–6, an alternate embodiment of the present invention is shown. According to FIG. 4, an arrangement with multiple valve portions is designated as multiple valve 46. The multiple valve 46 includes a valve body 48 having a lateral section 50 and a transverse section 12. The transverse section 12 includes connecting means shown as threaded portion 15 adjacent the distal end of transverse section 12 to mate with a vessel enclosing a fluid reservoir. As with the drain valve 5 shown in FIGS. 1–3, the multiple valve 48 includes an inlet passageway 11 formed in the transverse portion 12.

Inlet passageway 11 communicates with a manifold 52 that is common to plurality of individually operated valves shown as valves 54, 56 and 58. Each of valves 54, 56 and 58 of the system comprise the elements of drain valve 5 of FIGS. 1–3 and operate as described above. As seen in FIGS. 5 and 6, individual valves 54, 56, and 58 comprise an outlet sleeve 24 and a closure member shown as cable end fitting 26. A cable 36 to actuate each of valves 54, 56 and 58 is placed longitudinally within an aperture formed in the cable end fitting 26 and secured by cable end nut 42. As with drain valve 5, a protective sheave 38 surrounds cable 36. Valves 54, 56 and 58 are thereby independently operated to discharge fluid at their outlets at a desired time in the directions denoted by arrow 25.

FIG. 6 illustrates the bidirectionality of the present invention. The outlet sleeve 24 and cable end fitting 26 of any of valves 54, 56 and 58 may be interchanged within the ends of the valves to reverse the direction of any of the valves. The valves may thereby be directed in any direction desired. This arrangement has an application as a mixing valve.

Figure 7:
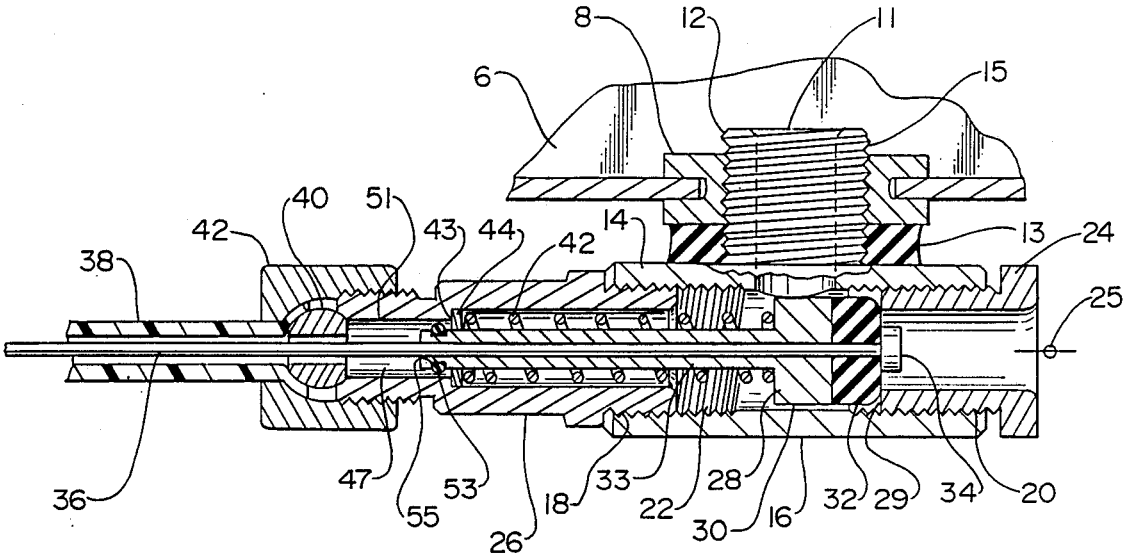
FIG. 7 is a detailed sectional view of an alternative embodiment of the drain valve of the present invention particularly adapted for increased fluid pressures.

The invention has a particular application in the removal of oil from an internal combustion crankcase. The invention could also be employed for any remotely actuated control of fluid from a fluid reservoir. With little or no modification, the invention may withstand moderate amounts of pressure and operate efficiently and smoothly. For example FIG. 7 shows the elongated portion 33 of valve plunger 28 formed to extend into the distal end 47 of cable end fitting 26. In this embodiment, cable receiving aperture 27 and the distal end 47 of cable end fitting 26 are shaped to form a sleeve 51 to receive the elongated portion 33 of valve plunger 28. An O-ring seal 53 may fit within a channel 55 formed in the elongated portion 33 to provide a seal with the sleeve 51 formed in the distal end 47 of the cable end fitting 26. This arrangement is particularly advantageous for use at increased fluid pressures.

While particular embodiments of the invention has been shown and described, it will be understood, of course, that the invention is not limited thereto, since modifications may be made and other embodiments of the principles of this invention pertains, particularly upon the foregoing teachings.

What is claimed is:

1. A remotely actuated, reversible valve for draining fluid from the drain outlet of a fluid reservoir comprising:

a valve body defining a longitudinal fluid passageway therein, said body having a pair of substantially identical connecting means located at the opposite ends of said passageway;

said valve body further including a transverse section, said transverse section defining a transverse passageway in communication with said fluid passageway, connecting means adjacent the distal end of said transverse section for providing fluid communication between said transverse passageway and said fluid reservoir;

an outlet sleeve joined with the connecting means at one end of said body, said outlet sleeve having an annular sealing surface disposed adjacent said one end, said outlet sleeve defining a longitudinal outlet port;

a closure member having a portion operatively connected to the connecting means of the other end of said body, said closure member cooperating with said longitudinal section to define a valve chamber;

a valve member disposed within said longitudinal passageway for longitudinal motion between an open position and a closed position, said valve member including a generally cylindrical sealing head for forming a seal with said sleeve sealing surface when said valve member is set to said closed position;

a biasing spring between said closure member and said sealing head, said biasing spring cooperating with fluid in said valve chamber to urge said valve member to the closed position; and cable means extending longitudinally through said closure member and connected to said valve member for withdrawing said sealing head from said sealing surface to said open position.

2. The valve of claim 1, wherein said fluid reservoir is the oil sump of an internal combustion engine having a drain aperture and including means for sealing said body to said oil sump to provide fluid communication through said aperture and said transverse passageway.

3. The valve of claim 1, wherein said outlet sleeve and said closure member may be interchanged to selectively determine the direction of fluid flow in said longitudinal passageway.

4. The valve of claim 1, wherein said pair of connecting means comprise internally threaded portions at the opposite ends of said longitudinal passageway.

5. The valve of claim 1, wherein said sealing head is loosely fit within said longitudinal passageway to permit fluid flow between the periphery of said head and said housing.

6. A remotely actuated, reversible valve for draining fluid from the drain outlet of a fluid reservoir comprising:

a valve body having a manifold defining a plurality of longitudinal valve portions, each defining a longitudinal fluid passageway, said valve body including a transverse section defining a transverse passageway in communication with each of said longitudinal passageways, connecting means adjacent the distal end of said transverse section for providing fluid communication between said transverse passageway and said fluid reservoir, each said valve portion including a longitudinal section having a pair of substantially identical connecting means located at the opposite ends of said longitudinal section;

an outlet sleeve joined with the connecting means at one end of said longitudinal section, said outlet sleeve having an annular sealing surface disposed adjacent said one end, said outlet sleeve defining a longitudinal outlet port;

a closure member having a portion operatively connected to the connecting means of the other end of said longitudinal section, said closure member cooperating with said manifold to define a valve chamber;

a valve member disposed within said longitudinal section for longitudinal motion between an open position and a closed position, said valve member including a generally cylindrical sealing head for forming a seal with said sealing surface when said valve member is set to said closed position;

a biasing spring between said closure member and said sealing head, said biasing spring cooperating with fluid in said valve chamber to urge said valve member to the closed position; and cable means extending longitudinally through said closure member and connected to said valve member for withdrawing said sealing head from said sealing surface to said open position whereby each said valve portion is independently operated to selectively direct fluid from said outlet port.

7. The valve of claim 6, wherein each said valve portion may be selectively reversed to redirect fluid flow in the opposite direction.

* * * * *